US007735410B2

(12) United States Patent
Clark

(10) Patent No.: US 7,735,410 B2
(45) Date of Patent: Jun. 15, 2010

(54) FIREARM BOLT

(76) Inventor: Robert Bernard Iredale Clark, Penwood House, St. Breward, Bodmin, Cornwall (GB) PL30 4YR ( * ) Notice: Subject to any disclaimer, the term of this patent is extended or adjusted under 35 U.S.C. 154(b) by 0 days.

(21) Appl. No.: 12/390,839

(22) Filed: Feb. 23, 2009

(65) Prior Publication Data

US 2010/0122483 A1 May 20, 2010

Related U.S. Application Data

(62) Division of application No. 11/583,784, filed on Oct. 20, 2006, now abandoned.

(51) Int. Cl.
*F41A 19/64* (2006.01)
*F41A 15/00* (2006.01)

(52) U.S. Cl. ..... 89/138; 42/25; 42/69.02; 89/174

(58) Field of Classification Search ..... 89/174, 89/188, 138; 42/69.02, 25
See application file for complete search history.

(56) References Cited

U.S. PATENT DOCUMENTS

| | | | | | |
|---|---|---|---|---|---|
| 804,699 | A * | 11/1905 | Benet et al. | ..... | 42/25 |
| 3,027,672 | A * | 4/1962 | Sullivan | ..... | 42/16 |
| 5,499,569 | A * | 3/1996 | Schuetz | ..... | 89/197 |
| 6,182,389 | B1 * | 2/2001 | Lewis | ..... | 42/16 |

* cited by examiner

*Primary Examiner*—Stephen M Johnson
*Assistant Examiner*—Daniel J Troy
(74) *Attorney, Agent, or Firm*—Eugene L. Flanagan, III

(57) ABSTRACT

An improved bolt carrier for a firearm is provided that improves the overall reliability and performance of the firearm bolt assembly. The bolt carrier includes a bolt with a body having a number of lugs extending therefrom. The bolt includes an extractor recess sized and configured to avoid any undercut of the lugs adjacent the recess. The bolt also includes an extractor pivotably engaged in a recess formed in the bolt. The extractor has a pair nipples on flanges configured to engage a pair of integrally buffered springs disposed on a tapered spring well on either side of a firing pin bore extending through the bolt.

4 Claims, 9 Drawing Sheets

FIREARM BOLT

This is a divisional of U.S. patent application Ser. No. 11/583,784 filed Oct. 20, 2006 in the names of Paul Leitner-Wise, et al. entitled FIREARM BOLT ASSEMBLY WITH FULLY-SUPPORTED BOLT FACE.

FIELD OF THE INVENTION

The present invention relates to firearm bolt assemblies and more particularly to the improved design of a bolt and extractor for use therewith.

BACKGROUND OF THE INVENTION

The M-16 automatic rifle has been a standard weapon of choice for the U.S. Military. The M-16 family of weapons includes semi-automatic counterparts which are popular with the civilian sector. The structure and mechanisms of these weapons, and improvements and variations thereto, have been the subject of many patents over the years. U.S. Pat. Nos. 2,951,424 and 3,198,076 to Stoner provide early examples of the M-16 type of weapon. In recent years, many variations and modifications of the M-16 family have evolved.

Generally, the M-16 family of automatic and semi-automatic rifles is based on a gas-operated bolt carrier system. The bolt carrier system includes a multi-lug bolt that interlocks, within the receiver, with a barrel extension engaged to the rifle barrel for firing each round of ammunition. The bolt also includes a spring-loaded extractor configured to releasably engage a cartridge as it is placed in the firing chamber. When the rifle is fired, the interlocked bolt receives the recoil force that is transmitted from the face of the bolt to its lugs. The lugs in turn transmit the recoil force to corresponding lugs of the barrel extension. Once the round is fired, the bolt unlocks from the barrel extension and the bolt carrier recoils. As it recoils, the extractor pulls the expended cartridge from the firing chamber. The cartridge is then ejected, as is well known in the art, to allow chambering of another round by the bolt assembly. This process may then be repeated as often as desired by the shooter until the last cartridge is expended.

As used herein, "gun" or "firearm" refers to a completely assembled weapon including not only a receiver operable to fire rounds of ammunition, but also any other structure normally associated with the given weapon. Also as used herein, a "receiver" includes a barrel extension, barrel interface, or any other part or assembly of a gun or firearm that has one or more surfaces configured to engage lugs of a breech bolt.

The design of the bolt carrier and bolts used in such weapons has been the subject of previous patents. For example, U.S. Pat. No. 5,351,598 to Schuetz discloses a new type of bolt for an automatic weapon. A portion of some of the lugs on the front face of the bolt have been removed to allow easier chambering of short, low pressure pistol cartridges in an M-16 rifle.

U.S. Pat. No. 6,182,389 to Lewis discloses a bolt with a body having a number of lugs extending therefrom, as well as an extractor pivotably engaged in a recess formed in the bolt, the extractor having a pair of flanges configured to engage a pair of springs disposed on either side of a firing pin bore extending through the bolt.

While the prior art has addressed some of the deficiencies in the design of bolts and bolt carriers of automatic and semi-automatic rifles, there still exists many problems in the use of such assemblies. It is well known that the bolts are subject to failure due to the extreme stresses and temperatures to which they are subjected from repeated firing of the gun.

This problem is particularly focused with respect to the lugs projecting from the main body of the bolt. As described above, the lugs are used to transfer the force from the firing of the cartridge to the barrel of the rifle. This problem is exacerbated further by the fact that automatic and semi-automatic rifles typically employ an unsymmetrical locking system in order to accommodate the extractor. The lack of symmetry of the load bearing portion of the bolt results in an uneven stress distribution among the lugs. Thus, the lugs of bolts for rifles are subject to structural failure due to the repeated high stresses induced by firing the rifle.

One of the common structural failures occurs at the lugs adjacent to the recess formed in the body of the bolt to accommodate the extractor. In forming this recess , the adjacent lugs are typically undercut and weakened relative to the other lugs.

These failures limit the overall reliability of the weapon, sometimes represented as Mean-Time-Between-Failure (MTBF). By reducing the frequency of these failures, maintenance-actions for the gun are correspondingly reduced and overall reliability is improved.

Another problem known in the art involves the extractor that is typically coupled to a bolt of an automatic or semi-automatic rifle. The extractor is known to malfunction, thus causing a jamming of the rifle due to the spent cartridge remaining in the firing chamber. As previously described, the extractor is typically spring-loaded. In the prior art extractors, the spring has a relatively short length due to the small amount of space between the outer surface of the bolt and the firing pin bore defined by the bolt for receiving the firing pin. The short length of the spring makes it much more difficult to control and maintain the tension to ensure it remains at the proper setting.

While the prior art devices attempt to address some of the problems with bolts and bolt carriers for rifles, there are still problems existing in the art requiring a need for a bolt that effectively addresses those problems. The present invention is directed toward providing various improvements to bolt carriers and bolts for automatic and semi-automatic rifles, and addresses the problems and the shortcomings of the prior art in a novel and unobvious way.

SUMMARY OF THE INVENTION

The present invention addresses the foregoing shortcomings in the design of bolt carriers and bolts for automatic and semi-automatic rifles. In accordance with one aspect of the present invention, a bolt for a firearm includes an elongated body having a proximal end and an opposite distal end along a longitudinal axis. The body defines an intermediate portion having an outer surface. A number of bolt lugs are integrally connected to the outer surface of the intermediate portion and extend radially from the body about the longitudinal axis. Each of the bolt lugs has an end face adjacent the distal end of the body and an opposite bearing face. Each lug also has a pair of sidewalls extending between the end face and the bearing face.

In accordance with another aspect of the present invention, the bolt includes an elongate body having a proximal end and an opposite distal end along a longitudinal axis. The body defines a generally cylindrical body portion having an outer surface and a firing pin bore extending between the proximal and distal ends. The body further includes a number of fully radiused bolt lugs positioned adjacent the distal end integrally connected to the body. The bolt lugs radially extend from the body about the longitudinal axis. The bolt lugs include at least a first bolt lug and an adjacent second bolt lug. An extractor-accomodating recess is formed in the body between the first bolt lug and the adjacent second bolt lug without undercutting either of said first and second bolt lugs.

In a further aspect of the invention, the bolt body further defines a pair of tapered spring wells oppositely disposed about the firing pin bore in the recess and oriented such that their longitudinal central axes are parallel. An integrally dampened spring is disposed within each of the spring wells, and an extractor is configured to reside in the recess and be pivotably coupled to the body. The extractor includes a first portion extending between the first and second bolt lugs, and an extractor body extending to a second portion. The second portion of the extractor body has a pair of oppositely disposed flanges extending therefrom. Each of the flanges contains an integrally formed nipple or spring stabilizing pin to engage the corresponding one of the springs to bias the extractor between a first and second position to releasably engage a cartridge. As used in this specification, radiused means that care has been taken to round off the corners of the embodiments of the present invention in order to ensure a more even stress distribution.

In another aspect of the present invention, an integrally-dampened spring sized and configured to minimize lateral movement within the spring wells is disposed within each of the spring wells.

In another aspect of the present invention, a bolt carrier for a firearm is provided. The bolt carrier comprises a conventional bolt carrier for an autoloading weapon system of the M-16/AR15 family having a bolt defining a firing pin bore therethrough and an extractor pivotably coupled to the bolt. A pair of nippled flanges extend from the extractor. The flanges engage a corresponding integrally dampened spring positioned on opposite sides of the firing pin bore within the bolt.

It is one object of the present invention to provide an improved extractor for a bolt used in a firearm that reduces or prevents extractor failures.

It is another object of the present invention to provide an improved lug design for a bolt that reduces or prevents structural failure of the bolt.

It is yet another object of the present invention to provide a reliable and safe design of a bolt and bolt carrier used with a firearm.

It is yet another object of the present invention to provide an integrally dampened extractor spring for a bolt used in a firearm that reduces or prevents spring failures.

These and other objects of the present invention will be more apparent from the following description of the figures and preferred embodiments.

DESCRIPTION OF THE PREFERRED EMBODIMENTS

Figure 1:
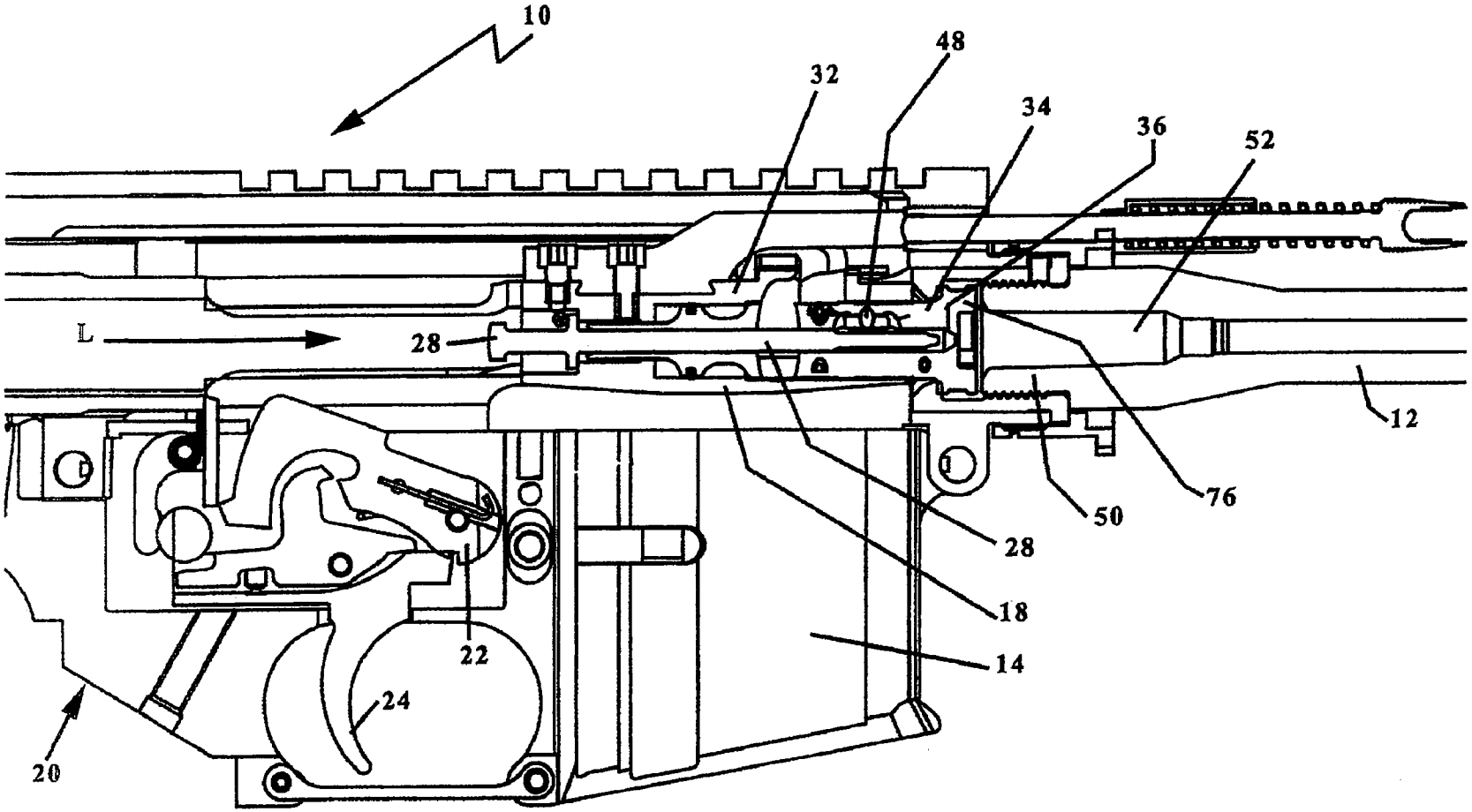
FIG. 1 is a diagrammatic cross-sectional side view of one embodiment of the present invention.

For the purposes of promoting an understanding of the principles of the invention, reference will now be made to the embodiments illustrated in the drawings and language will be used to describe the same. It should be understood that no limitation of the scope of the invention is intended by the illustrations; alterations and further modifications of the illustrated device and such further applications of the principles of the invention as illustrated herein being contemplated and fully expected to fall within the scope of the invention.

A firearm according to one embodiment of the present invention is depicted in FIG. 1 and designated generally as 10. Firearm 10 has barrel 12 and magazine 14. Magazine 14 is configured, as is well-known in the art, to feed cartridges 52 to a cartridge chamber through cartridge chamber interface 18. The cartridge chamber is defined by receiver 20. Receiver 20 includes trigger assembly 22 with spring-loaded trigger 24, spring-loaded hammer 26, and firing pin 28. Receiver 20 also defines a cavity configured to house bolt carrier 32. Bolt carrier 32 includes a bolt 34 residing therein. Bolt 34 defines firing pin bore 36 for receiving firing pin 28 therethrough. Bolt 34 also includes a spring-loaded extractor 42 pivotably coupled thereto. Extractor 42 has guide flange and is pivotably coupled by pivot pin 48 to bolt 34. Barrel 12 is coupled to barrel extension 50. Barrel extension 50 defines a firing chamber therein for receiving a cartridge 52 chambered by bolt carrier 32.

Figure 2:
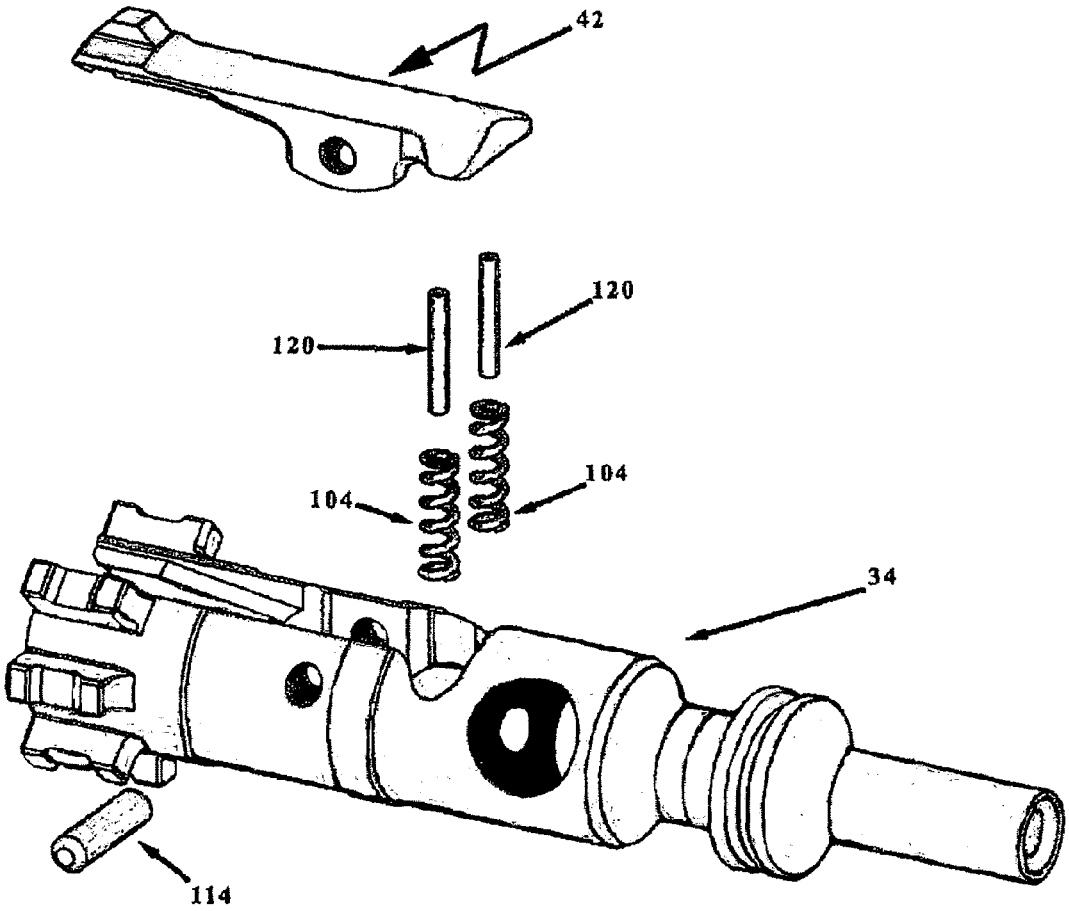
FIG. 2 is a three dimensional illustration of the bolt, the integrally buffered spring and the extractor of one embodiment of the present invention.
Figure 3:
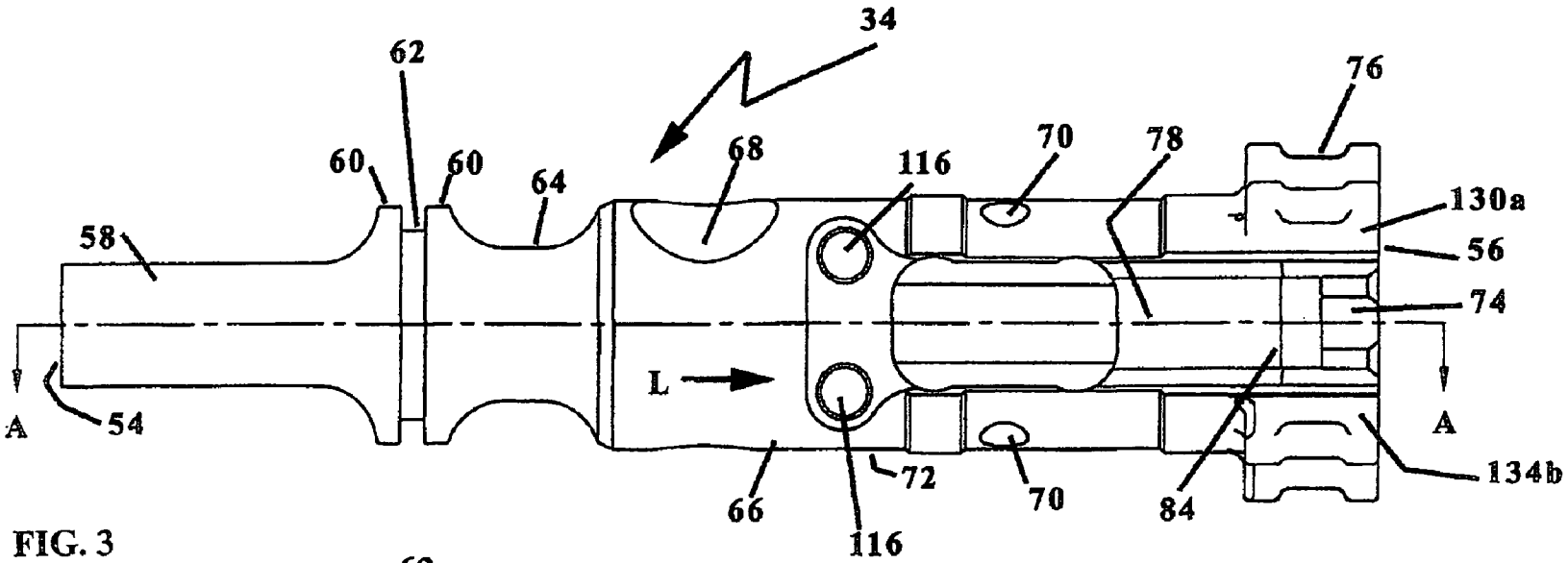
FIG. 3 is a top view of the bolt illustrated in FIG. 2.
Figure 5:
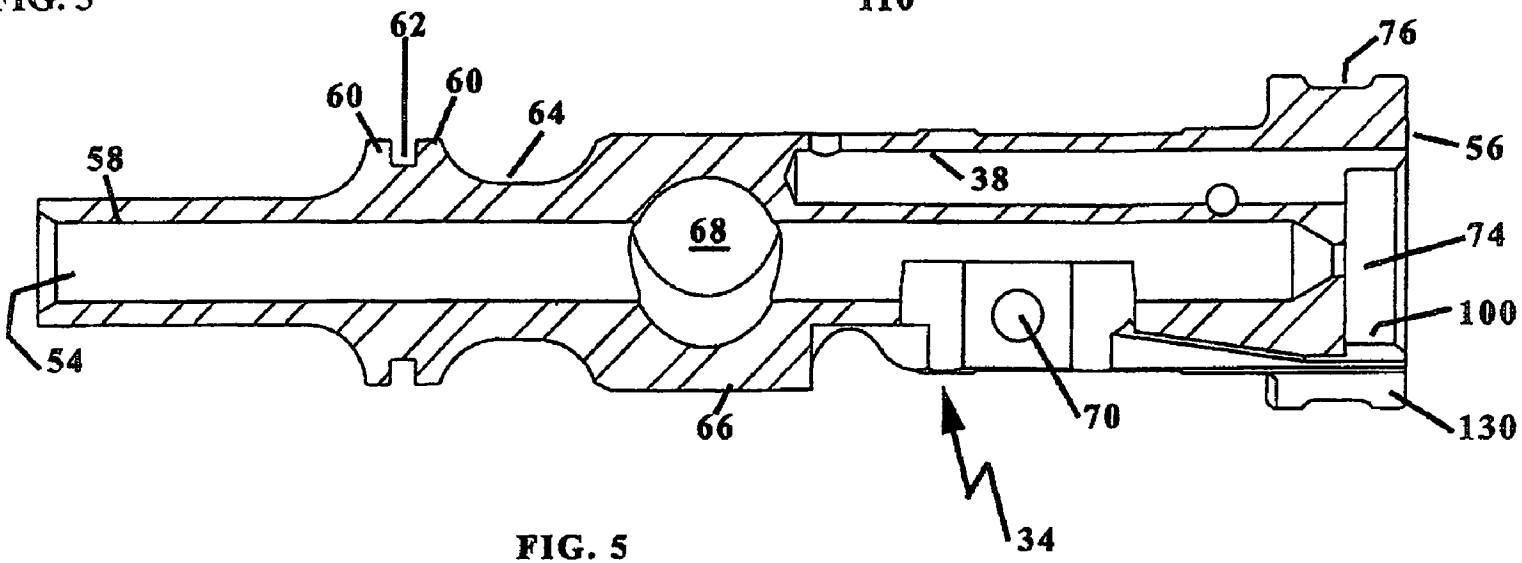
FIG. 5 is a cross-sectional view of the bolt depicted in FIG. 2 in the direction of A.

Referring now to FIGS. 2, 3 and 5, further description of bolt 34, shown removed from bolt carrier 32, is provided. Bolt 34 defines an elongate body having a proximal end 54 and an opposite distal end 56 along longitudinal axis L. Bolt 34 includes integrally formed stem 58 adjacent proximal end 54. Circumferential flanges 60 are integrally formed with stem 58. The flanges 60 form a groove 62 therebetween for receiving a sealing ring (not shown). Bolt 34 is also formed with a neck portion 64 extending from the flanges 60 to cylindrical body portion 66. Cylindrical body portion 66 defines a first bore 68 and a second pin bore 70 therethrough. Cylindrical body portion 66 also defines an outer surface 72 thereabout and a cartridge bearing surface 74 at distal end 56.

The outer surface 72 of the bolt 34 has a lug bearing portion 76 adjacent distal end 56. Body portion 66 of bolt 34 also defines extractor recess 78. The extractor recess 78, formed on the outer surface 72, is in communication with firing pin bore 36 and is configured to receive extractor 42 therein. An extractor bearing portion 80 resides within extractor recess 78 adjacent distal end 56 and is integrally formed with body portion 66. Extractor bearing portion 80 is configured to engage an underside 82 of extractor 42. In a preferred embodiment, extractor bearing portion 80 includes a mating surface 84 (see FIG. 2) defining a curved plane substantially parallel to the outer surface 72 of the bolt 34 such that cartridge bearing face 74 is circular. The underside 82 of extractor 42 is also preferably curved so that it engages bearing portion 84 in a form fitting engagement. In another embodiment, underside 82 of extractor 42 and mating surface 84 define a substantially flat plane.

Referring now to FIGS. 2 and 4A-4C, extractor 42 includes a guide flange 44 at first portion 90, extractor flanges 92 at second portion 94, and an extractor body 96 extending therebetween. Extractor recess 78 is positioned on cylindrical body portion 66 such that first portion 90 of extractor 42 substantially coincides with distal end 56 of bolt 34. Lip 98 of extractor 42 is then biased between a first and second position to removably retain a cartridge (not shown) in cartridge recess 100 (see FIG. 5) formed at distal end 56. At the underside 82 of each of the flanges 92 of extractor 42 is a spring stabilizing pin or nipple 102 designed to engage an integrally dampened extractor spring 104.

Cartridge recess 100 includes cartridge bearing face 74. The retained cartridge resides within cartridge recess 100 such that the end of the cartridge bears against bearing face 74 to transfer the load from firing the cartridge to the bolt 34. Extractor mating surface 84 defines a portion of the circumference of cartridge bearing surface 74.

Preferably, the circumference of cartridge bearing surface 74, including the portion defined by mating surface 84, is circular and cartridge bearing surface 74 receives the entire circular end portion of the retained cartridge in bearing engagement. In another embodiment, mating surface 84 and underside 82 of extractor 42 define a flat plane, and the circular end of the retained cartridge is not fully received in bearing engagement against cartridge bearing surface 74. A portion of the end of the cartridge projects above mating surface 84. In the preferred embodiment, the co-extensive bearing surface reduces and more evenly distributes the stress on the bolt lugs created during firing and extraction of the cartridge. Extractor 42 also includes pin receiving portion 110 extending therefrom. Pin receiving portion 110 defines extractor bore 112 therethrough. Extractor bore 112 is configured to align with pin bores 70 when extractor 42 is positioned within extractor recess 78. Pivot pin 114 is extended through pin bores 70 and extractor bore 112 to pivotably engage extractor 42 to bolt 34.

Figure 6A:
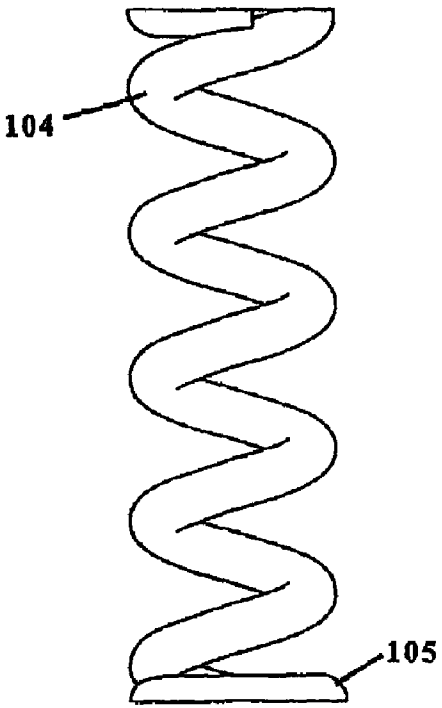
FIG. 6A is an illustration of a spring according to one embodiment of the present invention.
Figure 6B:
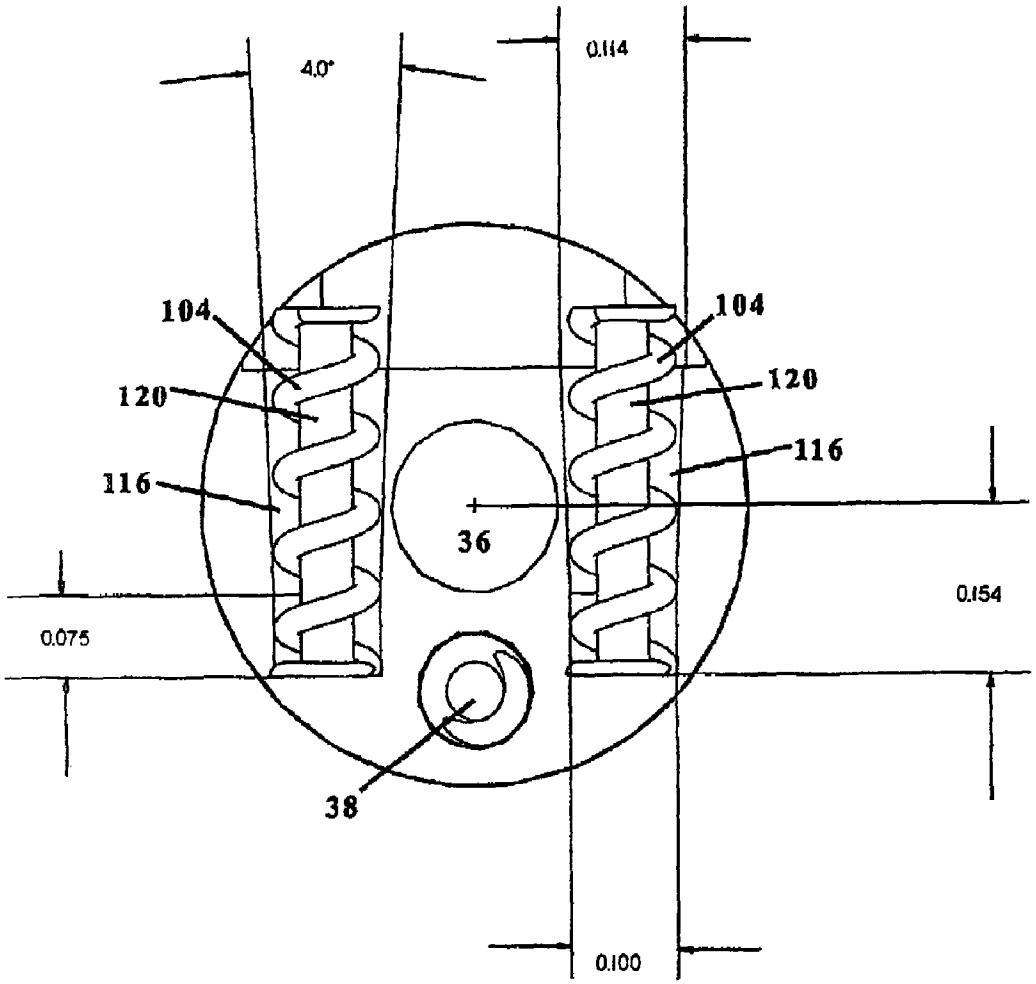
FIG. 6B is a cross-sectional view of the bolt depicted in FIG. 2 showing a pair of tapered spring wells containing integrally dampened springs.

Referring to FIG. 2 and FIG. 6B, extractor recess 78 is provided with a pair of spring wells 116. Spring wells 116 are formed in body portion 66 on opposite sides of firing pin bore 36. The central axes of the spring wells 116 are parallel to one another and are perpendicular to the longitudinal axis of the bolt. Spring wells 116 are each configured to receive an extractor spring 104 therein as more clearly illustrated in FIG. 2. The spring wells 116 are preferably tapered, and are sized and configured to receive a spring 104 that is preferably sized and configured with a slightly larger base coil 105 in order to minimize lateral movement of the spring 104 inside the well 116. (See FIGS. 6A and 6B). Referring to FIG. 6B, the larger base coil 105 allows the spring to be captured at the bottom of the spring well; the buffer dampens spring bounce; and the tapered spring well minimizes spring contact with the walls under distortion. In a preferred embodiment, the base coil is about 5% larger in diameter than the rest of the spring coils. When extractor 42 is engaged to bolt 34 as described above, each one of the nipples 102 on the flanges 92 engages a corresponding spring 104 positioned in a spring well 116. The preferred dimensions, in inches, of a spring and spring well according to one embodiment of the present invention are shown in FIGS. 6B. The degree of taper of the spring well 116 is shown as an angle θ. Angle θ is preferably in the range from about 2 to about 6 degrees, more preferably, about 4°. In a preferred embodiment, each spring 104 contains an integral buffer 120. The springs 104 are configured to pivotably bias extractor 42 radially inward to allow lip 98 to engage the rim of a cartridge. However, springs 104 must have the requisite flexibility to allow movement of extractor lip 98 radially outward to eject a cartridge.

The positioning of integrally dampened springs 104 inside the tapered spring wells 116 provides many advantages over prior art bolt designs. Lateral movement of the springs is decreased not only by the larger-base coil design of the springs 104 and the tapered spring wells 116, said lateral movement is further decreased by the engagement of the springs by the extractor nipples 102 on the underside 82 of the flanges 92 of extractor 42. Vibrational motion of the spring is further dampened by use of an integral buffer 120. The integral buffer 120 can be made with any material known in the art. The buffer material should be heat resistant to at least 500 degrees Fahrenheit; leaving no chance of burning from the heat generated by the rifle.

Figure 7:
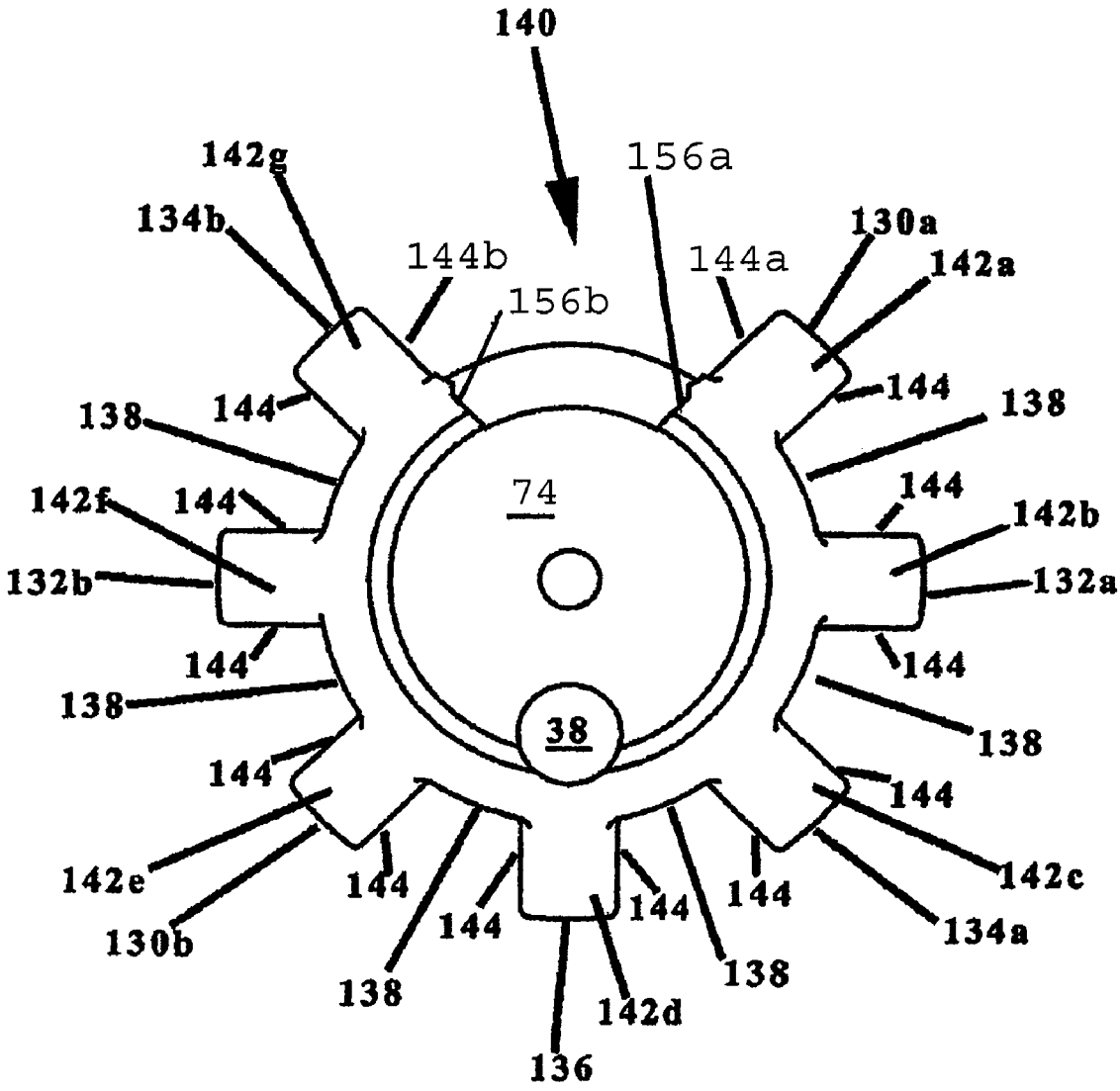
FIG. 7 is an end view of the bolt depicted in FIG. 2.

Referring now to FIG. 7, lug bearing portion 76 includes a number of bolt lugs 130*a*, 130*b*; 132*a*, 132*b*; 134*a*, 134*b*; and 136. To spread the recoil forces as evenly as possible, the bolt preferably has an odd number of lugs spaced, with the exception of the lugs adjacent to the extractor recess, equidistant apart. For example, the bolt depicted in FIG. 7 has seven lugs. Each bolt lug radially extends about the longitudinal axis of the bolt. Lugs 130*a*, 130*b* are collectively designated as lug pair 130 and extend opposite each other. Lugs 132*a*, 132*b* are designated as lug pair 132 and extend radially opposite each other. Finally, lug pairs 134*a*, 134*b* are designated as lug pair 134 and likewise extend radially opposite each other. Bolt lug 136 has no paired lug and extends radially opposite extractor 42, which is positioned between adjacent first lug 130*a* and second lug 134*b*.

Each adjacent pair of bolt lugs defines a gap 138 therebetween. The first lug 130*a* and the second lug 134*b* are adjacent one another and define an extractor gap 140. Extractor gap 140 is configured to receive the first portion 90 of extractor 42. Each lug 130*a*, 132*a*, 134*a*, 136, 130*b*, 132*b*, and 134*b* defines a corresponding end face 142*a*, 142*b*, 142*c*, 142*d*, 142*e*, 142*f* and 142*g* (collectively designated as end face 142), respectively and a pair of sidewalls 144. In the prior art, first lug 130*a* and second lug 134*b* are most susceptible to failure because they are undercut by the extractor recess in order to accommodate the first portion 90 of the extractor 42. In a preferred embodiment of the present invention, first lug 130*a* and second lug 134*b* are not undercut by the extractor recesses as the mating surface 84 does not extend under the plane of the sidewall 144*a* of the first lug 130*a* and the plane of the sidewall 144*b* of the second lug 134*b*.

Figure 7A:
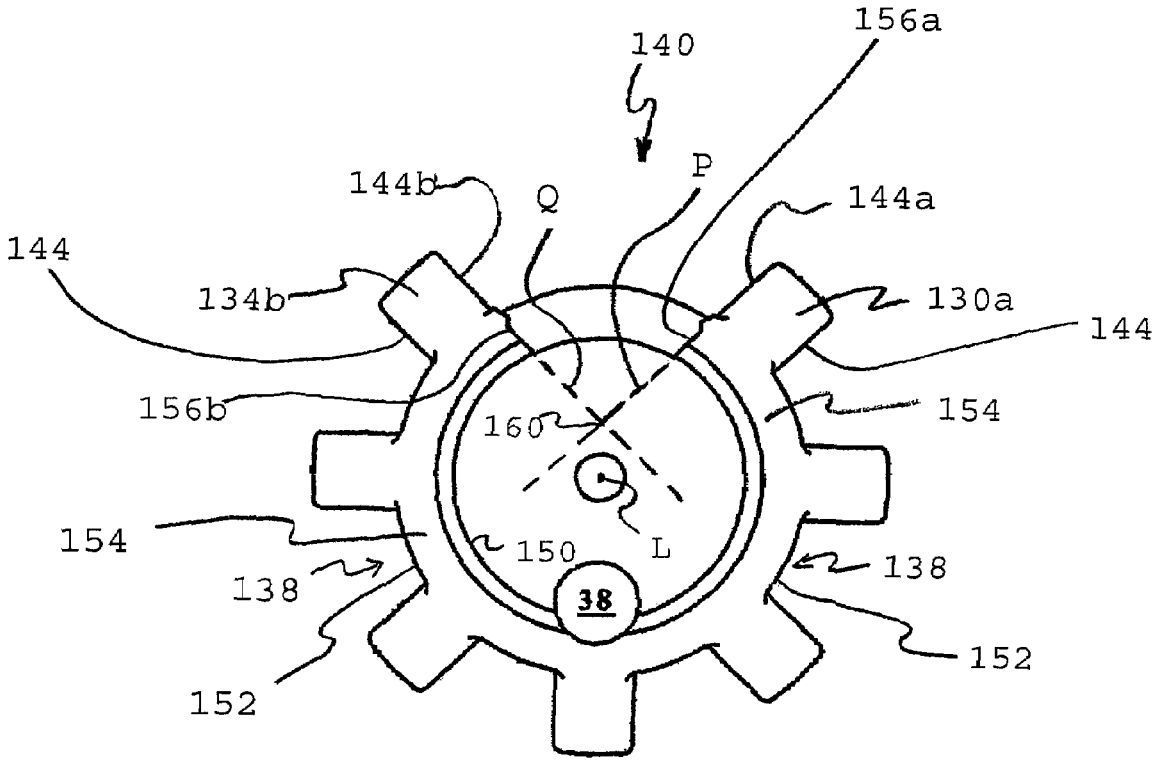

FIG. 7A is a further end view of the bolt corresponding to that of FIG. 7, but with references provided to illustrate certain features of the bolt. It will be seen from FIG. 7A, as well as from FIG. 5, that cartridge recess 100 is defined laterally by a cylindrical surface, indicated as 150 in FIG. 7A. Also, the distal portion of the bolt, as shown in FIG. 7A defines cylindrical surfaces 152 at the gaps 138 interspersed with the lugs 130*a*, 132*a*, 134*a*, 136, 130*b*, 132*b* and 134*b*, and the recess 140. Accordingly, the cylindrical surfaces 152 and the cylindrical surface 150 define an annular portion 154 from which the lugs extend radially outwardly. As will be seen from FIG. 7A, annular portion 154 is interrupted by the extractor gap 140, terminated at one side of recess 140 by a surface 156*a* which is coplanar with sidewall 144*a* of lug 130*a* and on the opposite side of extractor gap 140 by a surface 156*b* which is coplanar with sidewall 144*b* of lug 134*b*. Since surface 156*a* is coplanar with sidewall 144*a* of lug 130*a*, it will be seen that the thickness of the annular portion 154 beneath lug 130*a* is undiminished with respect to the thickness of the annular portion 154 beneath an opposing sidewall 144 of lug 130*a*. Also, since surface 156*b* is coplanar with sidewall 144*b* of lug 134*b*, it will be seen that the thickness of the annular portion 154 beneath lug 134*b* is undiminished with respect to the thickness of the annular portion 154 beneath an opposing sidewall 144 of lug 134*b*.

The plane of sidewall 144*a* of first lug 130*a*, in which surface 156*a* lies, is indicated in FIG. 7A by the dashed line P. The plane of sidewall 144*b* of second lug 134*b*, in which surface 156*b* lies, is indicated in FIG. 7A by the dashed line Q. The longitudinal axis of the bolt is indicated as L in FIG. 7A.

It will be seen from FIG. 7A that the planes represented by the dashed lines P and Q intersect between the longitudinal axis L and the recess 140 as indicated at 160.

Figure 7B:
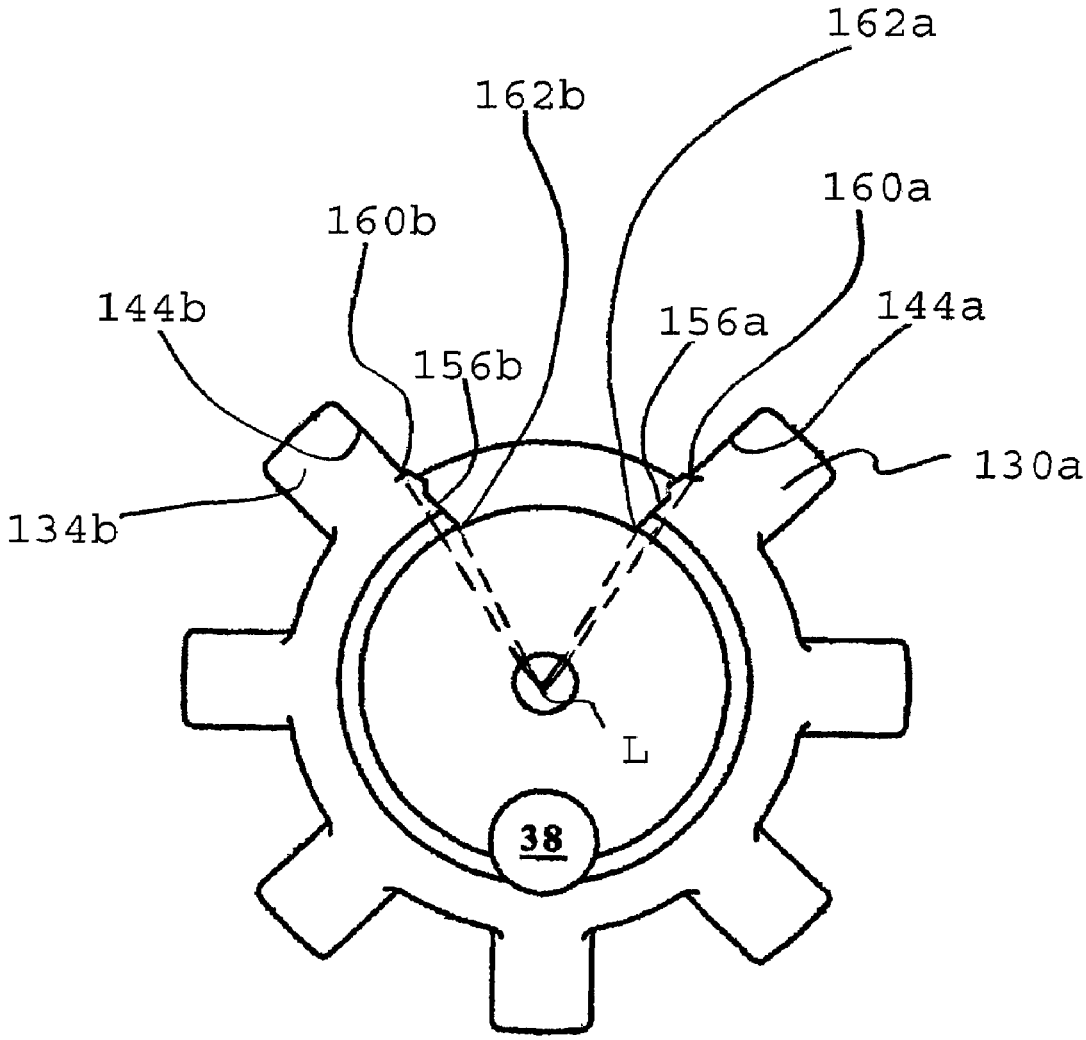

FIG. 7B is a another end view of the bolt corresponding to that of FIG. 7 and FIG. 7A, but with references provided to illustrate certain additional features of the bolt. As will be seen from FIG. 7B, surface 156*a* meets a radially inward edge of sidewall 144*a* of lug 130*a* at a position 160*a*, while surface 156*b* meets a radially inward edge of sidewall 144*b* of lug 134*b* at a position 160*b*. A radially innermost edge 162*a* of surface 156*a* meets the cylindrical surface 150 on a first side of the extractor gap 140, while a radially innermost edge 162*b* of surface 156*b* meets the cylindrical surface 150 on a second side of the extractor gap 140. A first pair of dashed lines in FIG. 7B trace a first angle from position 160*a* to the longitudinal axis L as its vertex, and from this vertex to position 160*b*. A second pair of dashed lines trace a second angle from the innermost edge 162*a* of surface 156*a* to the longitudinal axis L as its vertex, and from this vertex to innermost edge 162*b* of surface 156*b*. It will be seen from FIG. 7B that the first angle is larger than the second angle.

Receiver 20 also includes barrel extension 50 as illustrated in FIGS. 1. Barrel extension 50 is configured to interlock with lug portion 76 of bolt assembly 32 during firing of the firearm. Barrel extension 50 includes a barrel receiving end opposite a bolt receiving end. Adjacent the barrel receiving end is a connecting portion which is configured to engage barrel 12 as is known in the art.

Figure 8:
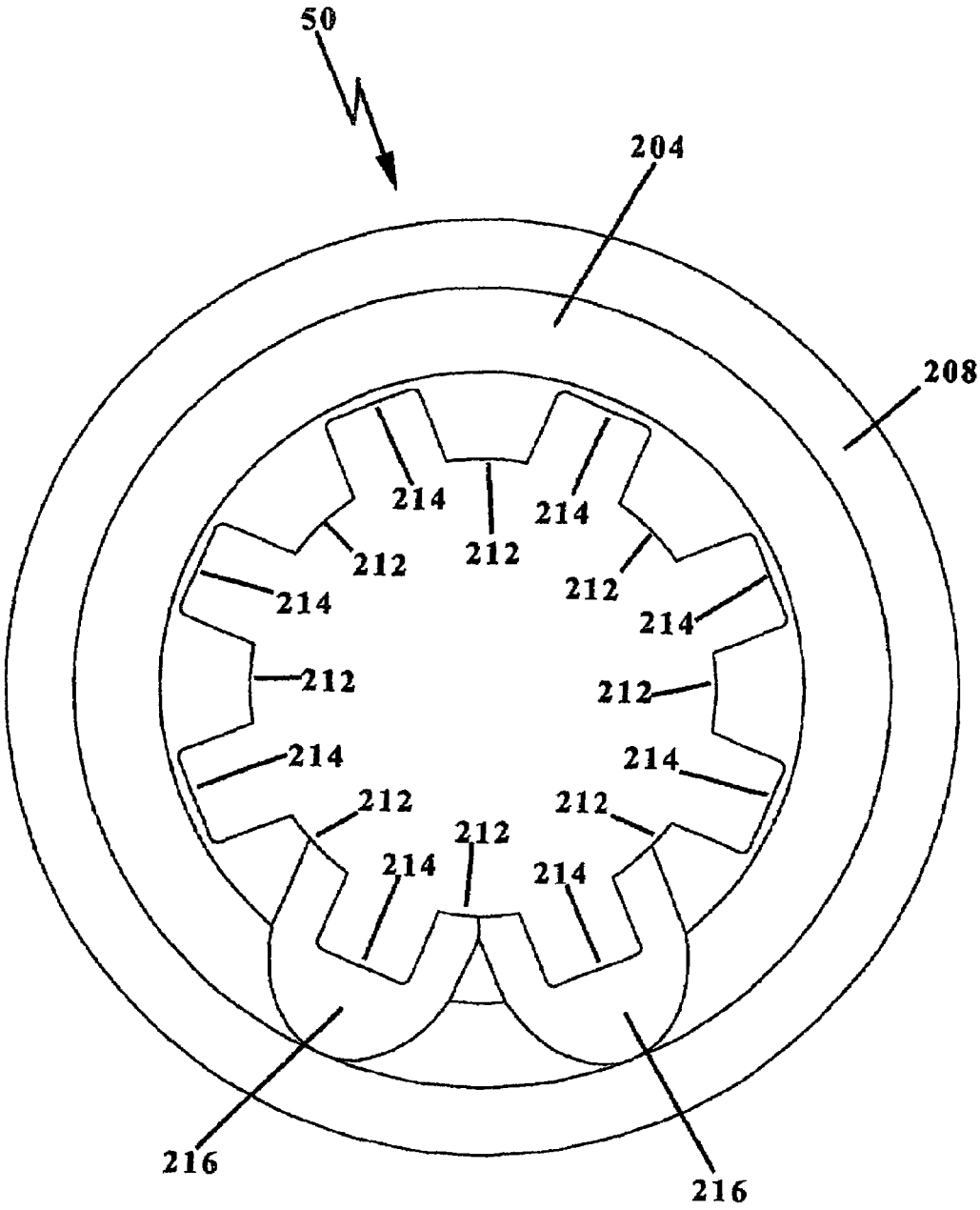
FIG. 8 is an end view of the barrel interface of the rifle depicted in FIG. 1.

The bolt receiving end includes extension lugs 212. (See FIG. 8). Extension lugs 212 define receiving gaps 214 therebetween. Feed ramp 216 is defined proximate a pair of adjacent extension lugs 212 to facilitate insertion of a cartridge and lug portion 76 through bolt receiving end 204. Each extension lug 212 defines an interlock face which engages a corresponding one of the lug bearing faces of the bolt lugs.

In operation, bolt carrier 30 moves in a reciprocal fashion along longitudinal axis L when rounds are fired from firearm 10 in a conventional automatic or semi-automatic manner. This operation is well-known in the art. U.S. Pat. No. 2,951,424 to Stoner, U.S. Pat. No. 3,198,076 to Stoner, and U.S. Pat. No. 5,351,598 to Schuetz provide further information pertinent to this process and are incorporated herein in their entireties. Generally, the operation begins with a cartridge from magazine 14 being fed into cartridge recess while bolt 34 is in the open position, as shown in FIG. 1. Bolt 34 then slides forward in the direction indicated by arrow B to position the cartridge in firing chamber 16. As bolt 34 moves forward, the lug pairs 130, 132, 134, and lug 136 of lug portion 76 pass by the extension lugs 212 of barrel extension 50 in interdigiting fashion through receiving gaps 214. Likewise, guide flange 44 passes through a receiving gap 214. Simultaneously, extension lugs 212 pass through a corresponding gap 138 or 140 of lug portion 60.

After the lugs of bolt 34 and barrel extension 50 have passed in interdigiting fashion, bolt carrier 32 continues to move in the direction of arrow L, causing the bolt 34 to rotate about axis L and interlock the bolt 34 in a closed position. (See FIG. 1). Lug portion 76 rotates in interlock chamber 210 of barrel extension 50 as is well known in the art, causing the bolt 34 to interlock with the barrel extension 50. Once the bolt 34 is interlocked with barrel extension 50, the cartridge in firing chamber 16 may be fired by pulling trigger 24. The pulling motion on trigger 24 rotates the hammer 26 from an engaged cocked position, as shown in FIG. 1, to an unengaged position. Hammer 26 rotates to strike firing pin 28. Firing pin 28 moves within firing pin bore 36 of bolt 34 to strike the cartridge in firing chamber 16, causing the cartridge to fire.

After firing a cartridge, bolt 34 is rotated to unlock from barrel extension 50 and bolt carrier 32 recoils back in receiver 20 in a direction opposite arrow L to an open position, as shown in FIG. 1. As the bolt carrier 32 recoils, ejector pin 40 in shaft 38 is driven towards distal end 56 until it engages the spent cartridge held in cartridge recess by lip 98 of extractor 42. The operation of ejector pins is well-known in the art, and will not be discussed in detail herein. The ejector pin 40 ejects the spent cartridge by rotating the cartridge away from the cartridge recess. The rotation of the cartridge causes extractor 42 to rotate about pivot pin 114 from its first position, compressing springs 104. The extractor 42 rotates sufficiently to disengage lip 98 of extractor 42 from the rim of the cartridge. Once the cartridge is released from lip 98, springs 104 again bias extractor 42 to return to its first position. When the next cartridge is chambered, the extractor 42 again rotates from its biased first position to allow the lip 98 to engage a cartridge and releasably retain it in the cartridge recess. This operation is repeated at the discretion of the shooter to consecutively load and fire cartridges. It should be understood the present invention contemplates the use of other ejector systems known to those skilled in the art.

The firing of a cartridge in firing chamber 16 causes a recoil force in the direction opposite arrow L. Bolt lug pairs 130, 132, 134 and lug 136 bear against a corresponding interlock face of the extension lugs 212. Thus, a load bearing relationship is formed between lug pairs and the extension lugs. The force from firing the cartridge is transferred from lug portion 76 of the bolt 34 to the extension lugs 212. This force has been known to create large shear stresses at the interface between the bolt lug pairs and cylindrical body portion 66. Rapid and/or repeated firing of the cartridges is known to cause fatigue failure of the bolt lugs at this interface. The problem becomes even more severe due to the unsymmetrical pattern created by the lug pairs 130, 132, 134 and unpaired lug 136. The lack of symmetry results in an unbalanced stress distribution among the bolt lugs. As a result, first bolt lug 130*a* and second bolt lug 134*b* share a disproportionate burden of the load.

As clearly illustrated by FIG. 6 of U.S. Pat. No. 6,182,389, the disclosure of which is incorporated herein in its entirety, not only do the first and second lug bolt lugs bear a disproportionate burden of the load, they also have an extractor undercut that further structurally weakens them leading to a high failure rate. On the other hand, and as clearly illustrated in FIGS. 2 and 7 herein, the first and second bolt lugs of the preferred embodiment of the present invention are not undercut to accommodate the extractor. Moreover, the lug portion 76 is fully radiused in order to have a more even stress distribution.

The present invention also contemplates bolt lug patterns that vary from the pattern illustrated in FIGS. 2-7. In one embodiment, the bolt 34 is provided with five bolt lugs in lieu of the seven bolt lugs depicted in FIG. 7. Another embodiment contemplates nine bolt lugs. Other embodiments contemplate more or less bolt lugs as would occur to one skilled in the art.

Figure 4C:
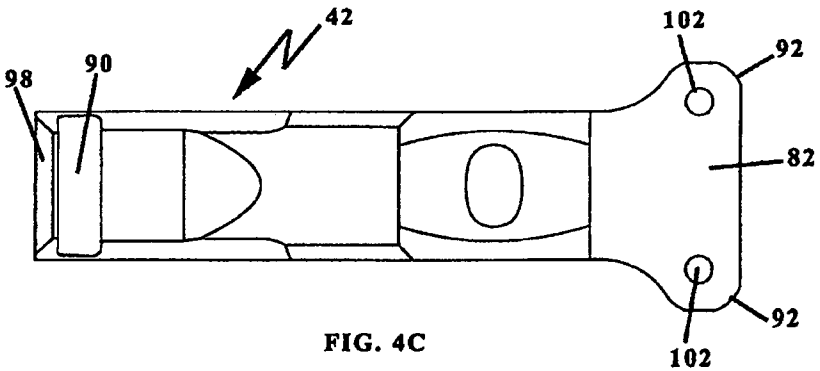
FIGS. 4A, 4B, 4C and 4D are different views of the extractor illustrated in FIG. 2.
Figure 4B:
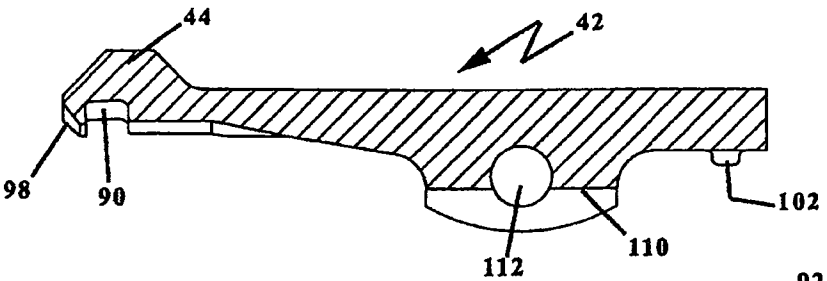
Figure 4D:
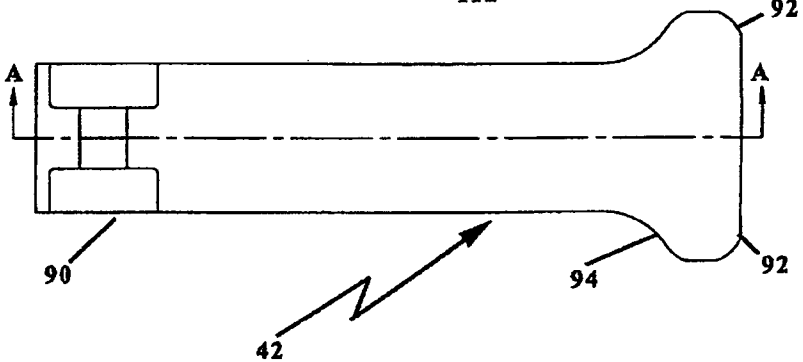
Figure 4A:
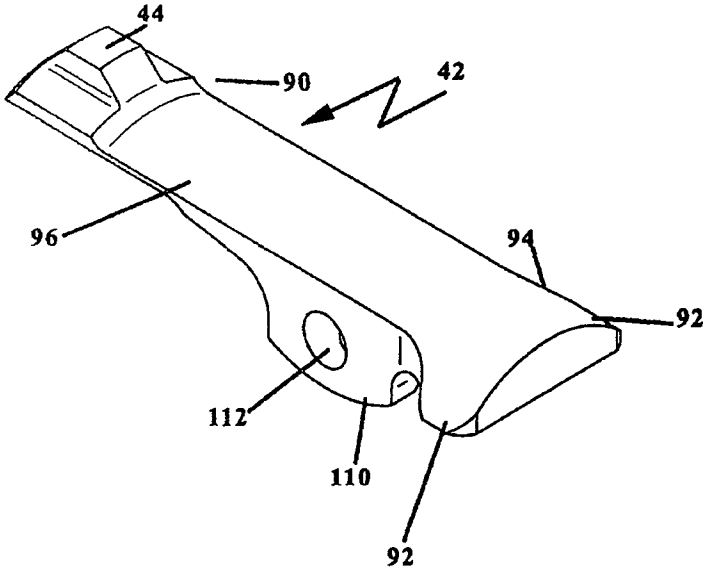

It has also been found that the above-described configuration of extractor 42 and bolt 34 is particularly advantageous. The addition of flanges 92 to extractor 42 allows the springs 104 to be positioned on either side of firing pin bore 36. Referring to FIG. 4C, it can be observed that addition of spring stabilizing nipples 102 to the flanges 92 of extractor 42 helps to stabilize the spring against lateral motion leading to more reliable operation. The prior art springs are more susceptible to fatigue failure given their excessive lateral motion inside the spring wells 116. Additionally, the dampening of the springs using buffers 120 also reduces spring vibration thus providing more reliable operation of the extractor 42.

Preferably, the springs 104, extractor 42 and bolt 34 are manufactured from a metal material suitable for use in firearms using techniques known to those skilled in the art. Furthermore, it is preferred that bolt 34 and extractor 42 be formed from a single, unitary piece of metal; however, in alternate embodiments, bolt 34 and extractor 42 may be made by coupling two or more separate components as would occur to one skilled in the art. Also, it is contemplated that extractor 42, bolt 34, and springs 104 may be formed from different materials suitable for their intended purpose.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A bolt for a firearm, comprising:

an elongate body having a proximal end, an opposite distal end and a longitudinal axis, the body at its distal end having an annular portion about the longitudinal axis defining an inner cylindrical surface and an outer extremity;

the body further including a number of bolt lugs adjacent its distal end extending radially outwardly from the outer extremity of the annular portion, the bolt lugs including at least a first bolt lug and a second bolt lug;

the annular portion of the body having a recess extending radially therethrough between a first recess surface and a second recess surface, the first recess surface extending parallel to a radially extending surface of the first bolt lug, the second recess surface extending parallel to a radially extending surface of the second bolt lug, each of the first and second recess surfaces extending in a respective plane such that the respective planes intersect.

2. The bolt of claim 1, wherein the first recess surface is coplanar with the outer surface of the first bolt lug and the second recess surface is coplanar with the outer surface of the second bolt lug.

3. A bolt for a firearm, comprising:

an elongate body having a proximal end, an opposite distal end and a longitudinal axis, the body at its distal end having a lug bearing portion defining an inner cylindrical surface and an outer extremity, the lug bearing portion including a number of bolt lugs extending radially outwardly from the outer extremity thereof;

the lug bearing portion having an extractor accommodating recess extending inwardly from its outer extremity between a first recess surface and a second recess surface, the first and second recess surfaces each extending in a respective plane positioned such that the respective planes intersect.

4. The bolt of claim 3, wherein the extractor accommodating recess extends longitudinally of the body beyond the lug bearing portion toward the proximal end of the body.

* * * * *